US005464057A

United States Patent [19]

Albano et al.

[11] Patent Number: 5,464,057

[45] Date of Patent: Nov. 7, 1995

[54] QUENCH COOLER

[76] Inventors: John V. Albano, 768 Glenside Court E., Oradell, N.J. 07649; Kandasamy M. Sundaram, 157-H Meriline Ave., West Patterson, N.J. 07424; Hellmut A. Herrmann, Feerenstrasse 36, Kassel, Germany

[21] Appl. No.: 248,337

[22] Filed: May 24, 1994

[51] Int. Cl.[6] ..... F28F 9/02

[52] U.S. Cl. ..... 165/173; 165/157; 165/174

[58] Field of Search ..... 165/134.1, 157, 165/173, 174; 208/48 Q; 422/801

[56] References Cited

U.S. PATENT DOCUMENTS

| | | | |
|---|---|---|---|
| 3,357,485 | 12/1967 | O'Sullivan et al. | 165/174 |
| 3,552,487 | 1/1971 | Tokumitsu et al. | 165/174 |
| 3,763,262 | 10/1973 | Sato et al. | 208/48 Q X |
| 4,248,834 | 2/1981 | Tokumitsu | 422/200 |
| 4,457,364 | 7/1984 | DiNicolantonio et al. | 165/134 |
| 5,029,637 | 7/1991 | Brücher et al. | 165/119 |
| 5,031,692 | 7/1991 | Kehrer et al. | 165/134.1 |

FOREIGN PATENT DOCUMENTS

| | | | |
|---|---|---|---|
| 1015443 | 9/1952 | France | 165/174 |
| 1433702 | 2/1966 | France . | |
| 2224899 | 12/1972 | Germany | 165/174 |
| 2551195 | 6/1977 | Germany . | |

*Primary Examiner*—Allen J. Flanigan

[57] ABSTRACT

A quench cooler or transferline heat exchanger for quenching the effluent from a hydrocracking furnace has an inlet coupling between the cracking furnace tubes and the tubes of the quench cooler which splits the flow into a plurality of branches. The flow passages are configured to initially decelerate and then re-accelerate the gas. This involves a conical diverging diffuser section and then a tapered and branched converging section. The cross sectional transitions are smooth to avoid dead spaces and minimize pressure loss.

5 Claims, 3 Drawing Sheets

QUENCH COOLER

BACKGROUND OF THE INVENTION

This invention relates to a novel heat exchanger or quench cooler for quenching the effluent from a hydrocarbon cracking furnace. More particularly, the invention relates to the coupling between the cracking furnace tubes and the tubes of the quench cooler or transferline exchanger.

In the production of light olefins (ethylene, propylene, butadiene and butylenes) and associated aromatics (benzene, toluene, ethylbenzene, xylenes and styrene) by the thermal cracking of hydrocarbon feedstocks in the presence of steam, the cracking reactions are stopped by rapidly cooling or quenching the cracking furnace effluent. The quenching time is measured in milliseconds and has the purpose of "freezing" the furnace outlet composition at its momentary value to prevent degradation of the olefin yield through continuing secondary reactions. A number of different quench cooler designs are available in the marketplace depending upon the quantity of cracked gas to be cooled, the fouling tendencies of the furnace effluent and the pressure/temperature conditions of the steam to be generated. These designs range from conventional fixed tubesheet shell and tube heat exchangers to double pipe designs.

It is well known that for any given cracking furnace operating conditions, the yield of olefins can be maximized and quencher fouling minimized by decreasing the temperature of the gas leaving the cracking furnace as rapidly as possible. This requires that the quench cooler be positioned as close as possible to the cracking furnace outlet, that the volume of the inlet section of the quench cooler be minimized and that the surface to volume ratio in the cooling section be maximized. The latter requirement implies that a multiplicity of small quencher tubes are more favorable than a single large diameter arrangement.

One prior art type of quench cooler known as the SHG transferline exchanger (Schmidt'sche Heissdampf - Gesellschaft mbH) uses a multiplicity of double tube arrangements in parallel wherein each quench tube is surrounded by a concentric outer tube which carries the water-steam mixture. The annuli between the inner and outer tubes are supplied with boiler water through horizontal, oval-shaped headers. In this regard, see German Patentschrift DE 2551195. Another prior art patent which uses this double tube arrangement with an oval header for the outside tubes is U.S. Pat. No. 4,457,364. This patent discloses a distributor having an inlet for the gas from the furnace and two or three diverging branches forming a wye or tri-piece for the transition between the furnace and the quench cooler. As indicated, this transition where cooling has not yet begun can be critical in minimizing continued reaction and undesirable coke deposits. In this U.S. Pat. No. 4,457,364, the cross sectional area for flow through the connector is substantially uniform to achieve substantially constant gas velocity throughout the distributor. The distributor may also be divergent in cross sectional area up to the point where the ratio of the sum of the cross sectional areas of the branches to the cross sectional area of the inlet is 2:1.

SUMMARY OF THE INVENTION

The inlet section or connector for a quench cooler between the furnace outlet and the inlets to the quench cooler tubes splits the flow into a plurality of branches and is designed to reduce the inlet section residence time to a minimum. In order to uniformly distribute the gas to a plurality of in-line arranged quench tubes, the flow passages are configured to first efficiently decelerate the gas leaving the furnace and then re-accelerate the gas to the quencher cooling tube velocity. More specifically, a conical diverging diffuser section in the connector decelerates the gases and then a tapered and branched converging section re-accelerates the gases as they are fed into the quench cooler tubes. The cross sectional transitions are smooth with monotonic area change in the flow direction (aerodynamic) so that dynamic pressure is recovered, dead spaces, i.e. zones of flow separation, are avoided and the pressure loss is minimal.

DESCRIPTION OF THE PREFERRED EMBODIMENT

Figure 1:
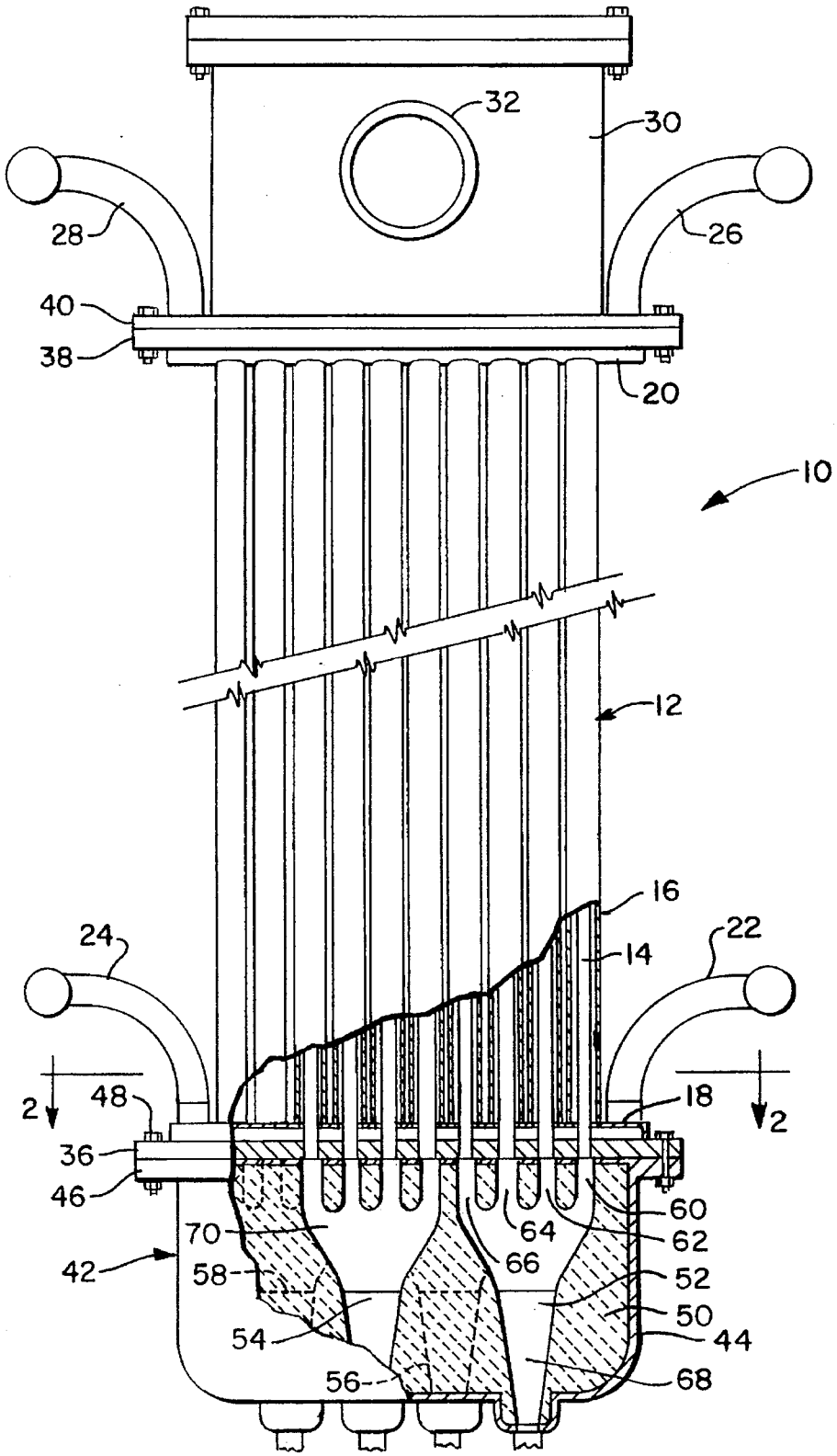
FIG. 1 shows a side elevation view of a quench cooler partially in cross-section incorporating the present invention.

Referring to FIG. 1, the quench cooler 10 comprises a plurality of double tube heat exchange elements 12 which in turn comprise the inner tubes 14 which carry the cracking furnace effluent gas surrounded by the outer tubes 16. The annulus between the two tubes carries the coolant water/steam mixture. The lower ends of the tubes 14 and 16 are connected to the oval headers 18 while the upper ends are connected to the oval headers 20.

Figure 3:
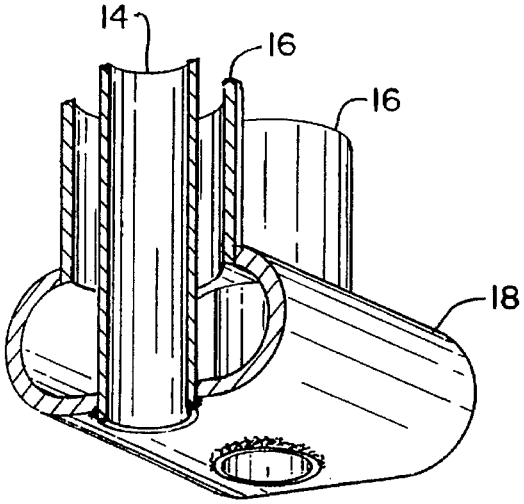
FIG. 3 is a perspective view of the connection of the tubes to and through the oval header.

The connection of the tubes to the oval headers is shown in detail in FIG. 3. The inner tubes 14 pass completely through the headers while the outer tubes 16 terminate at the header and are open to the inside of the header. Cooling water, which is supplied to the lower headers 18 via the coolant inlet connections 22 and 24, as shown in FIG. 1, flows through the lower headers, into the annular space between the tubes and upwardly emptying into the upper headers 20. The coolant, which is now a heated steam/water mixture, flows out from the headers 20 through the outlet connections 26 and 28. The cooled gas which is flowing up through the pipes 14, empties into the upper outlet chamber 30 and is discharged through the outlet 32.

Figure 2:
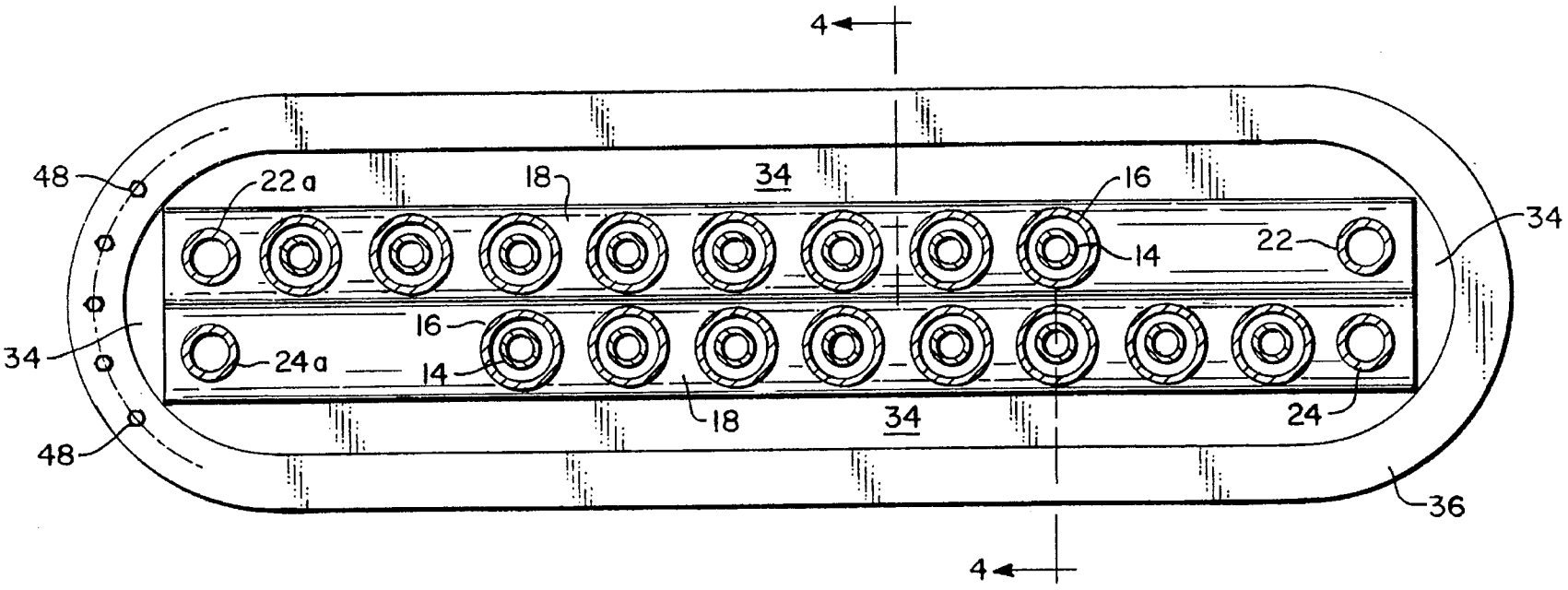
FIG. 2 is a cross-sectional view of the quench cooler of FIG. 1 taken along line 2—2.

Although other arrangements can be employed, the present invention is illustrated using a 16-tube arrangement which is best seen in FIG. 2. This figure shows the two oval headers 18 with eight tube combinations connected to each header. Two water inlet connections on each oval header are also shown at 22, **22*a*, 24 and 24*a*. The two headers 18 are joined to each other and joined to the surrounding plate 34 such as by welding. Around the periphery of the plate 34 is a flange 36 which is for the purpose of mounting the inlet connector to be described hereinafter. The upper oval headers 20 are similarly mounted including a flange 38 for attaching the flange 40 on the upper outlet chamber 30**.

The quench cooler of the present invention can be applied most advantageously with cracking furnaces (not illustrated) employing a relatively large number of low capacity cracking coils. For example, such a furnace might have twenty four coils each 12 meters (40 feet) in height with each coil formed from four 5 cm (2 in.) internal diameter tubes feeding into a single 10 cm (4 in.) internal diameter outlet tube. The effluent from four such coils can be quenched in a single quench cooler of the present invention. The illustrated embodiment of the invention feeds the effluent from each furnace coil and outlet tube (four furnace inlet tubes) into four quencher tubes. The quench cooler has sixteen quencher tubes so it can handle four furnace coils (sixteen furnace inlet tubes).

The inlet chamber 42 at the lower end of the quench cooler comprises a container or tub 44 which forms the pressure boundary. A flange 46 around the edge of the inlet chamber container is attached by bolts 48 to the flange 36. The container is filled with a high temperature refractory material 50 which has the uniquely shaped internal gas passages 52, 54, 56 and 58 of the present invention formed therein. These gas passages are formed by properly placed cores which are then removed after the refractory has set. For example, the cores may be dissolved or burned out of the refractory. Alternately, the gas passages can be formed of a cast or formed metal such as a high nickel chrome alloy, as illustrated at 53 in FIG. 4. In that case, the refractory is merely poured around the formed passages.

Figure 4:
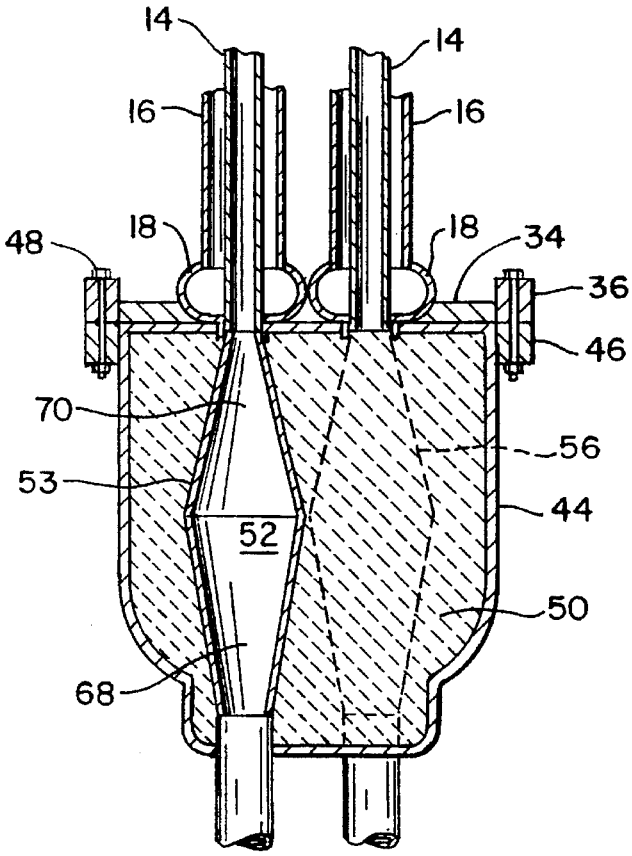
FIG. 4 is an end view of a portion of the quench cooler of FIG. 1 in cross-section.

In the illustrated embodiment of the present invention, each of the gas passages 52, 54, 56 and 58 is furcated or branched into four branches 60, 62, 64 and 66. Each branch connects to a single quench tube 14. Each gas passage comprises a first diverging conical diffuser portion 68 followed by a converging portion 70 which includes the branches. The conical diverging portion 68 can be seen in the two views shown in FIGS. 1 and 4. The converging portion is not as easily recognized since that portion begins with a divergence in one plane (FIG. 1) to spread out to the branches but with a convergance in the other plane (FIG. 4). The net effect of this combination of a divergence in one plane and a convergence in the other plane is a smooth or monotonic convergance of the flow area. Discontinuities are avoided which would create eddies and coking. Therefore, the gases are first decelerated in the conical diffuser and then re-accelerated back up to the quencher tube velocity. The smooth re-acceleration serves to avoid flow separation thereby minimizing coke formation in dead zones while providing a uniform flow distribution to the individual quencher tubes. As a specific example, the inside diameter of each inlet tube may be 10.16 cm (4 in.) and the inside diameter of the outlet of the diffuser may be 15.24 cm (6 in.) for a ratio of flow area of 2.25. The 15.24 cm (6 in.) maximum diameter then converges down to four (4) tubes of 5.7 cm (2.25 in.) for a ratio of flow area of 0.56.

Since the flow is re-accelerated without dead zones, coke deposition at the entrance to each tube is minimized. Even if coke is deposited in the tubes, deviation from uniform flow distribution is significantly reduced. This is the advantage of using an aerodynamically efficient diverging/converging passage instead of either a conventional transfer line exchanger inlet or a constant area or diverging bifurcation as shown in U.S. Pat. No. 4,457,364. In the latter case, flow separation in the wye or tri-piece and maldistribution to the transfer line exchanger tubes are likely. The result of applying the diverging/converging passage of the present invention is uniform distribution, reduced coking tendencies and consequently improved yields and increased run length.

We claim:

1. Connecting means for feeding cracked gases from a cracking furnace coil into the heat exchange tubes of a quench cooler, said connecting means containing a plurality of flow passageways and each passageway comprising a diverging conical inlet diffuser passage followed by an outlet section which is furcated into a plurality of individual outlet passages with each of said outlet passages adapted to feed one of said heat exchange tubes, said outlet section having a configuration such that the cross sectional flow area uniformly decreases in the direction of flow thereby forming a generally converging outlet section.

2. Connecting means as recited in claim 1 wherein said outlet section comprises at least four outlet passages.

3. Connecting means as recited in claim 1 wherein said connecting means comprises a ceramic insulating material and said passageways are formed in said ceramic material.

4. Connecting means as recited in claim 3 wherein said passageways in said ceramic material are lined with metal.

5. Connecting means as recited in claim 1 wherein the ratio of the diameter of said inlet passages to the diameter of one of said outlet passages is 2:1.

* * * * *

UNITED STATES PATENT AND TRADEMARK OFFICE

CERTIFICATE OF CORRECTION

PATENT NO. : 5,464,057

DATED : November 7, 1995

INVENTOR(S) : John V. Albano et al

It is certified that error appears in the above-indentified patent and that said Letters Patent is hereby corrected as shown below:

Title page, left column, "[76]" should read --[75]--.

Title page, left column, before "[21]" insert --[73] ABB Lummus Crest Inc., Bloomfield, New Jersey, and Schmidt'sche Heissdampf-Gesellschaft mbH, Kassel-Bettenhausen, Germany--.

Signed and Sealed this

Twenty-fourth Day of December, 1996

*Attest:*

Bruce Lehman

BRUCE LEHMAN

*Attesting Officer*

*Commissioner of Patents and Trademarks*